US005738266A

United States Patent [19]

Ogawa

[11] Patent Number: 5,738,266

[45] Date of Patent: Apr. 14, 1998

[54] GUIDE MECHANISM FOR USE IN NAILING MACHINE USING SERIES-CONNECTED NAILS

[75] Inventor: Tatsushi Ogawa, Tokyo, Japan

[73] Assignee: Max Co., Ltd., Tokyo, Japan

[21] Appl. No.: 638,328

[22] Filed: Apr. 26, 1996

[30] Foreign Application Priority Data

Apr. 28, 1995 [JP] Japan ..... 7-129482

[51] Int. Cl.[6] ..... B25C 1/04

[52] U.S. Cl. ..... 227/128; 227/119; 227/136

[58] Field of Search ..... 227/136, 119, 227/127, 128, 120, 135, 137

[56] References Cited

U.S. PATENT DOCUMENTS

| | | | |
|---|---|---|---|
| 3,550,831 | 12/1970 | Obergfell | 227/136 |
| 3,688,966 | 9/1972 | Perkins et al. | 227/136 |
| 3,703,981 | 11/1972 | Smith | 227/136 |
| 3,945,551 | 3/1976 | Sato et al. | 227/136 |
| 4,319,705 | 3/1982 | Geist et al. | 227/136 |
| 4,581,964 | 4/1986 | Takatsuru | 81/464 |
| 4,784,308 | 11/1988 | Novak et al. | 227/136 |
| 5,240,161 | 8/1993 | Kaneko | 227/109 |
| 5,332,141 | 7/1994 | Mukoyama et al. | 227/136 |

FOREIGN PATENT DOCUMENTS

| | | |
|---|---|---|
| 0 169 172 | 1/1986 | European Pat. Off. . |
| 0 360 573 | 3/1990 | European Pat. Off. . |
| 67 849 | 12/1973 | Luxembourg . |
| 581 532 | 11/1976 | Switzerland . |

*Primary Examiner*—Joseph J. Hail, III
*Assistant Examiner*—Jay A. Stelacone
*Attorney, Agent, or Firm*—Morgan, Lewis and Bockius LLP

[57] ABSTRACT

The disclosure presents a guide mechanism for a nailing machine in which series-connected nails are fed from a magazine to a nose portion and the foremost nail of the series-connected nails is driven from a nail ejecting outlet of the nose portion by a driver. The guide mechanism includes: a stationary wall formed between the nose section and the magazine; a door pivotable with respect to the stationary wall; a nail guide passage is defined by the stationary wall and by the door, for guiding the series-connected nails from the magazine to the nose portion; a head guide attached to the door, the head guide being abutted against the side surface of the head of each of the series-connected nails to guide the head of each nail; a shank guide attached to the door, for guiding the shank of each nail, the shank guide including a ratchet being movable towards and away from the stationary wall to vary the width of the nail guide passage; and a guide piece attached to the ratchet of the shank guide, the guide piece being protruding towards the stationary wall rather than towards the head guide, to engage with the lower surface of the head of each of the series-connected nails to support each nail.

4 Claims, 5 Drawing Sheets

GUIDE MECHANISM FOR USE IN NAILING MACHINE USING SERIES-CONNECTED NAILS

BACKGROUND OF THE INVENTION

This invention relates to a guide mechanism for series-connected nails loaded in a nailing machine which smoothly guides series-connected nails along a nail guide passage through which series-connected nails are supplied from a magazine to a nail ejecting outlet.

In general, a nailing machine using series-connected nails has a nail magazine in which series-connected nails are accommodated, and a nail guide passage is provided between the magazine and a nail ejecting outlet to guide and supply the nails from the magazine to the nail ejecting outlet. The nail guide passage is defined by a stationary wall which is provided between the magazine and the nail ejecting outlet, and by a door which is pivotable to and from the stationary wall.

Roughly stated, there are two kinds of series-connected nails; a series of wire-connected nails which are formed by connecting a number of nails to a wire at predetermined intervals, and a series of sheet-connected nails which are formed by connecting a number of nails to a connecting belt at predetermined intervals which is formed by bending a belt-shaped plastic sheet rectangularly. Those two kinds of series-connected nails are clearly different in nail shank width from each other depending on whether the nails are series-connected with a wire or whether they are series-connected with a connecting belt. Because of this difference, in the nailing machine, a ratchet is arranged inside the door in such a manner that it is movable to and from the stationary wall, and elastically urged towards the stationary wall at all times (as disclosed by Japanese Utility Model Application Laid-open No. Hei. 5-46850. Hence, in supplying a series of wire-connected nails small in nail shank width, the ratchet is moved towards the stationary wall by the elastic force of the spring. On the other hand, in the case of a series of sheet-connected nails, the nail shank width is larger as much as the connecting belt. Hence, in supplying sheet-connected nails, the ratchet is moved away from the stationary wall against the elastic force of the spring. Thus, depending on the kinds of series-connected nails, the ratchet adjusts the width of the nail guide passage automatically.

On the other hand, it should be noted that the series-connected nails are axially supported only by means of a guide groove through which the side of each of the nails is engaged with the stationary wall in the nail guide passage. Hence, as shown in FIG. 8(*a*), where the wire-connected nails are not supported by the magazine 31 with its last nail out of the magazine 31, the wire-connected nails are considerably unstably supported. When compared with the front end part of the series-connected nails, the rear end part, being supported only by the guide groove 32, is readily disengaged by the shock when hammered, and the nail point may come off a nail guide passage 33. As was described above, the front and rear end parts of the series-connected nails are not uniformly supported, and the series-connected nails are tilted in the nail guide passage 33, which obstructs the supplying of the series-connected nails. Especially, in the case where the nails are such that the heads are small and the shanks are short, as shown in FIG. 8(*b*), the nail is liable to be caught by a part 34*a* of a nail transferring pawl 34; that is, the jamming of nails may occur with the hammering machine.

SUMMARY OF THE INVENTION

Accordingly, an object of the invention is to eliminate the above-described difficulties accompanying a conventional guide mechanism for series-connected nails. More particularly, an object of the invention is to provide a guide mechanism for series-connected nails loaded in a nailing machine which is able to smoothly and positively supply wire-connected nails to the nail ejecting outlet of the nailing machine.

The foregoing object of the invention has been achieved by the provision of a guide mechanism for a nailing machine in which series-connected nails are fed from a magazine to a nose portion and the foremost nail of the series-connected nails is driven from a nail ejecting outlet of the nose portion by a driver, the guide mechanism comprising: a stationary wall formed between the nose section and the magazine; a door pivotable with respect to the stationary wall; a nail guide passage is defined by the stationary wall and by the door, for guiding the series-connected nails from the magazine to the nose portion; a head guide attached to the door, the head guide being abutted against the side surface of the head of each of the series-connected nails to guide the head of each nail; a shank guide attached to the door, for guiding the shank of each nail, the shank guide including a ratchet being movable towards and away from the stationary wall to vary the width of the nail guide passage; and a guide piece attached to the ratchet of shank guide, the guide piece being protruding towards the stationary wall rather than towards the head guide, to engage with the lower surface of the head of each of the series-connected nails to support each nail.

With the guide mechanism for series-connected nails, in supplying series-connected nails from the magazine to the nail ejecting outlet of the nailing machine, the ratchets are moved towards or away from the stationary wall according to the kind of series-connected nails thereby to adjust the width of the nail guide passage according to the width of the wire-connected nails. In supplying the wire-connected nails to the nail ejecting outlet, each nail is supported as follows: One side of the head of each nail is supported by the stationary wall, while the other side is abutted against the head guide formed on the door, and the lower surface of the head is engaged with the guide piece of the ratchet.

Even when, under this condition, the rear end portion of a series of wire-connected nails is not supported being moved out of the magazine, the head of each nail is positively and stably supported by the stationary wall, the head guide of the door, and the guide piece. Hence, the nailing machine is free from the difficulties that the series-connected nails drop down the nail guide passage by the shock when hammered, or caught by the nail transferring pawl.

As was described above, with the guide mechanism for series-connected nails, the latter will never be tilted at the door. Furthermore, even if the head and the shank of each nail are short, the jamming of nails will never occur with the nailing machine. Hence, with the guide mechanism, the wire-connected nails can be smoothly and positively supplied to the nail ejecting outlet of the nailing machine.

BRIEF DESCRIPTION OF THE DRAWINGS

FIG. 8(*b*) is an enlarged diagram showing the front portion of a connecting belt.

DETAILED DESCRIPTION OF THE PREFERRED EMBODIMENTS

Figure 1:
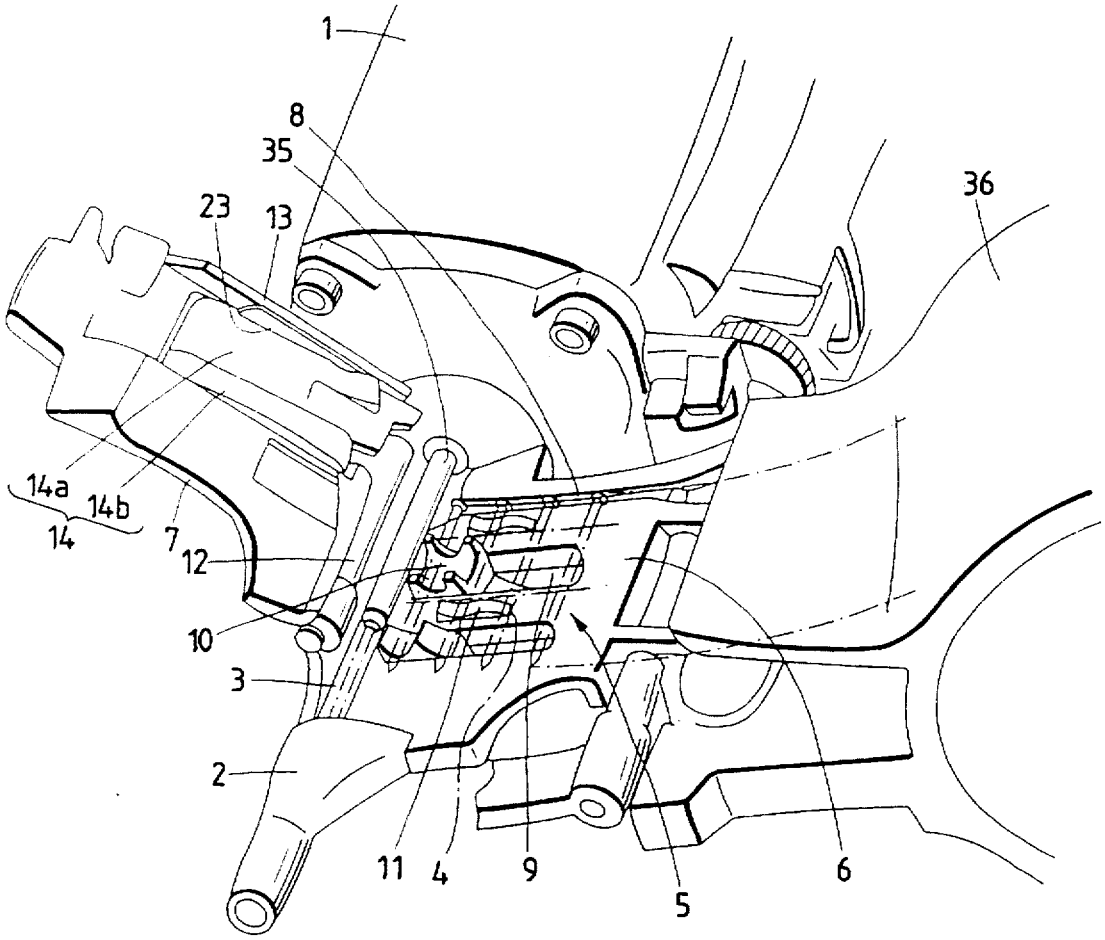
FIG. 1 is a perspective view showing a nailing machine having a guide mechanism for series-connected nails according to the invention with its nail guide passage opened.

FIG. 1 is a perspective view showing a nailing machine using series-connected nails in part. The nailing machine operates as follows: The foremost of series-connected nails 4 is supplied into the nail ejecting outlet of a nose section 2 which is provided at the end of a nailing machine body 1. The foremost nail is hammered with a driver 35 which is driven by a hammering mechanism, so that the foremost nail is hammered into a material through the nose section which is to be nailed (hereinafter referred to merely as "a material", when applicable).

As was described before, there are available two kinds of series-connected nails; wire-connected nails and sheet-connected nails which are different in width. The wire-connected nails are supplied to the nail ejecting outlet 3 from a magazine 36 through a nail guide passage 5. The sheet-connected nails are also supplied in the same way. In order for the nailing machine to be able to handle the two kinds of series-connected nails, namely, wire-connected nails and sheet-connected nails, the nail guide passage 5 is defined by a stationary wall 6 which is formed between the nose section 2 and the magazine 36, and a door 7 which is swingable to and from the stationary wall 6.

The stationary wall 6 has a guide groove 8 and an opening 9. The guide groove 8 is engaged with one side of the head of each of the series-connected nails 4. In the opening 9, a nail transferring pawl 4 for transferring series-connected nails is arranged in such a manner that it is reciprocatable. The pawl 10 is to engage with the shank of a nail 4 to transfer it. A drive device is provided outside the stationary wall 6 to drive the nail transferring pawl 10. On the inner surface of the stationary wall 6, reverse movement preventing pawl 11 are formed which prevents the series-connected nails 4 from being moved in the reverse direction when the pawl 10 returns.

The door 7 is pivotally mounted on a shaft 12 which is provided near the nail ejecting outlet 3. On the inner surface of the door 7, a head guide 13 and a shank guide 14 are formed. The head guide 13 is to abut against the side of the head of each nail 4 to guide it, and the shank guide 14 is to guide the shank of each nail. A tip guide is formed on the door 7.

More specifically, the head guide 13 is formed by using the inner surface of the upper portion of the door 7 which is confronted with the guide groove 8.

Figure 2:
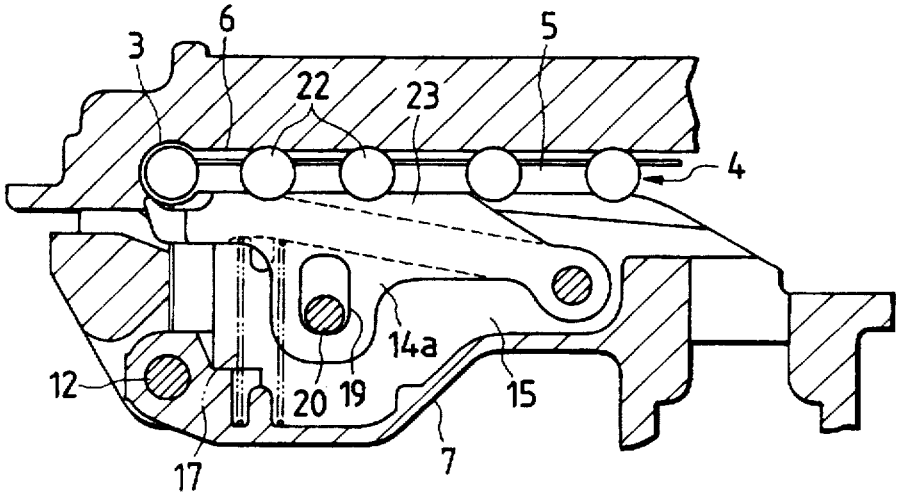
FIG. 2 is a sectional view of the nail guide passage including a cross-sectional view of an upper ratchet.
Figure 3:
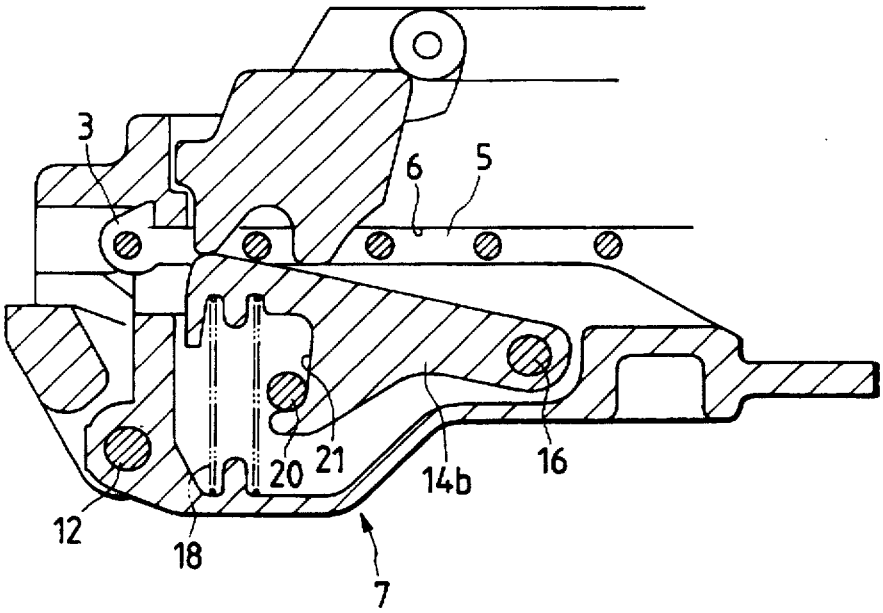
FIG. 3 is a sectional view of the nail guide passage including a cross-sectional view of a lower ratchet.

The shank guide 14 comprises an upper ratchet **14*a* and a lower ratchet 14*b*. As shown in FIGS. 2 and 3, the upper and lower ratchets 14*a* and 14*b* are positioned in a recess 15 formed in the door 7. One end portion of each of the ratchets 14*a* and 14*b* is swingably mounted on a shaft 16 which is provided between the upper and lower walls of the recess. As pivotable around the shaft 16, the ratchets 14*a* and 14*b* are moved towards or away from the stationary wall thereby to adjust the width of the nail guide passage 5. The ratchets 14*a* and 14*b* are kept urged towards the stationary wall 6 by springs 17 and 18 which are provided between their rear surfaces and the bottom of the recess 15. The upper ratchet 14*a* is limited in the range of movement by a pin 20 engaged with an elongated hole 19; and similarly the lower ratchet 14*b* is limited in the range of movement by the pin 20 engaged with a groove 21**.

Figure 4:
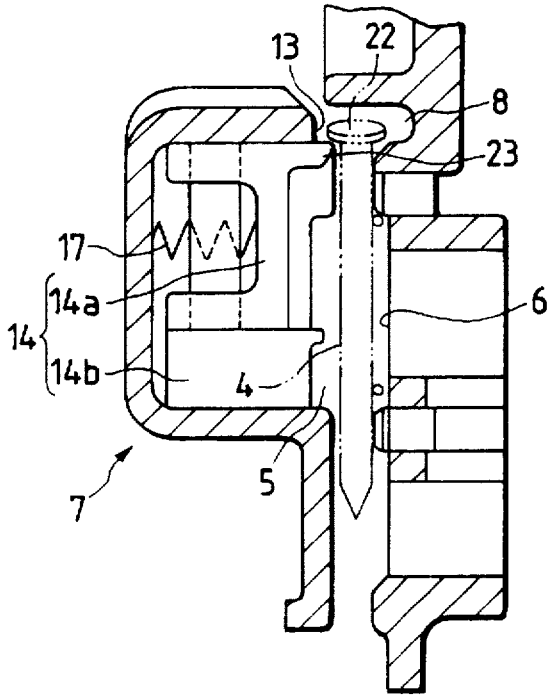
FIG. 4 is a sectional view of the nail guide passage including a longitudinal sectional view of the ratchet.

The upper ratchet **14*a*, as shown in FIG. 4, has a guide piece 23 at the upper end. The guide piece 23 is protruded towards the stationary wall 6 rather than towards the head guide 13. The guide piece is engaged with the lower surfaces of the heads 22 of the series-connected nails 4 in the nail guide passage 5, thus supporting the heads. The guide piece 23 extends to the rear of the door 7 so as to be arranged along the nail guide passage 5**.

With the above-described guide mechanism, the wire-connected nails 4 are supplied from the magazine 36 to the ejecting outlet 3 as follows. As shown in FIGS. 2 through 4, the ratchets **14*a* and 14*b* are moved towards the stationary wall 6 by the springs 17 and 18, thus decreasing the width of the nail guide passage 5 in correspondence to the width of the wire-connected nails. In the nail guide passage 5, one side of the head 22 of each nail is supported while being engaged with the guide groove 8 in the stationary wall 6, while the other side is abutted against the head guide 13 on the door 7, and the lower surface of the head 22 is supported being engaged with the guide piece 23. In other words, the series-connected nails are supported as follows: One side of the head 22 of each nail is engaged with the guide groove 8 of the stationary wall 6, while the other side is supported by the head guide 13 and the guide piece 23. Furthermore, the shank is supported being abutted against the stationary wall 6 and the shank guide 14**.

When, under this condition, the last of the series-connected nails 4 comes out of the magazine 36, the series-connected nails 4 are not supported by the magazine 36 any longer; however, at least on the side of the door 7, the head 22 of each nail, as shown in FIG. 4, is stably supported by the head guide 13 and the guide piece 23. Hence, the nailing machine is free from the difficulties that, when hammered, the series-connected nails 4 drop down the nail guide passages 5 or caught by the nail transferring pawl 10 by the shock.

Hence, with the guide mechanism of the invention, the wire-connected nails will never be tilted at the door. Furthermore, even if the head and shank of each nail are small, the nailing machine will never be jammed up with nails. That is, the wire-connected nails can be smoothly and positively supplied to the nail ejecting outlet 3.

Figure 5:
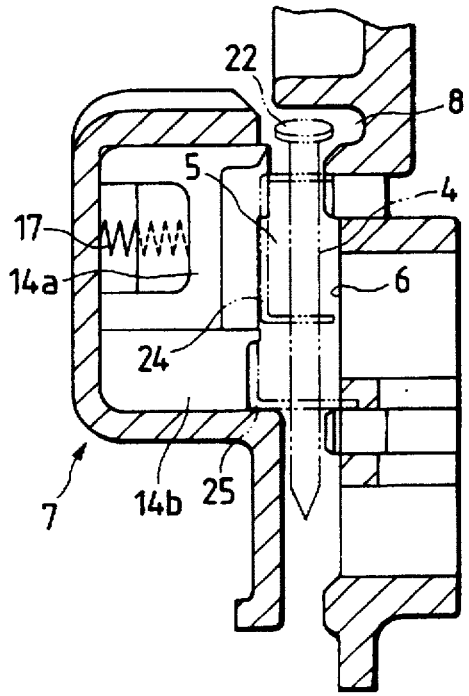
FIG. 5 is a sectional view showing series-connected nails loaded in the nail guide passage shown in FIG. 4.

In supplying the sheet-connected nails 4, as shown in FIG. 5 the ratchet **14*a* or 14*b* is pushed in according to the height of the coupling belt 24 or 25 of the sheet-connected nails 4, so that the latter 4 are guided while moving away from the stationary wall 6. As is apparent from the above description, the sheet-connected nails 4 are supplied, with the connecting belt itself positively supported by the door 7. That is, the sheet-connected nails, unlike the conventional wire-connected nails, will never be tilted in the nail guide passage 5**.

Figure 7:
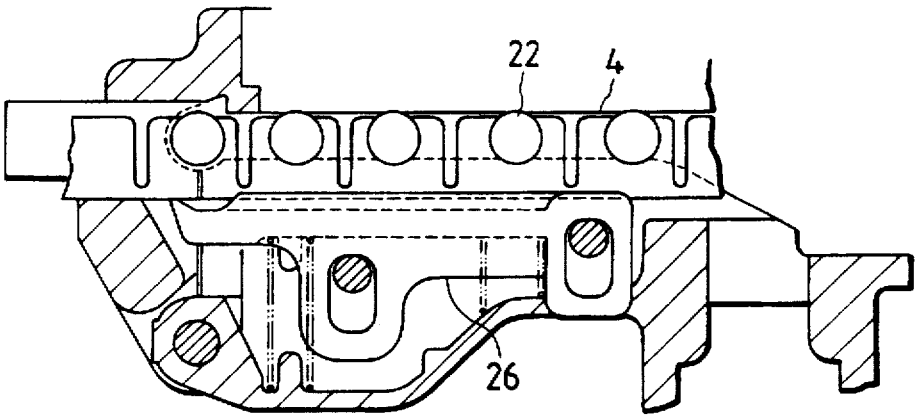
FIG. 7 is a sectional view showing sheet-connected nails loaded in the nail guide passage shown in FIG. 6.
Figure 8A:
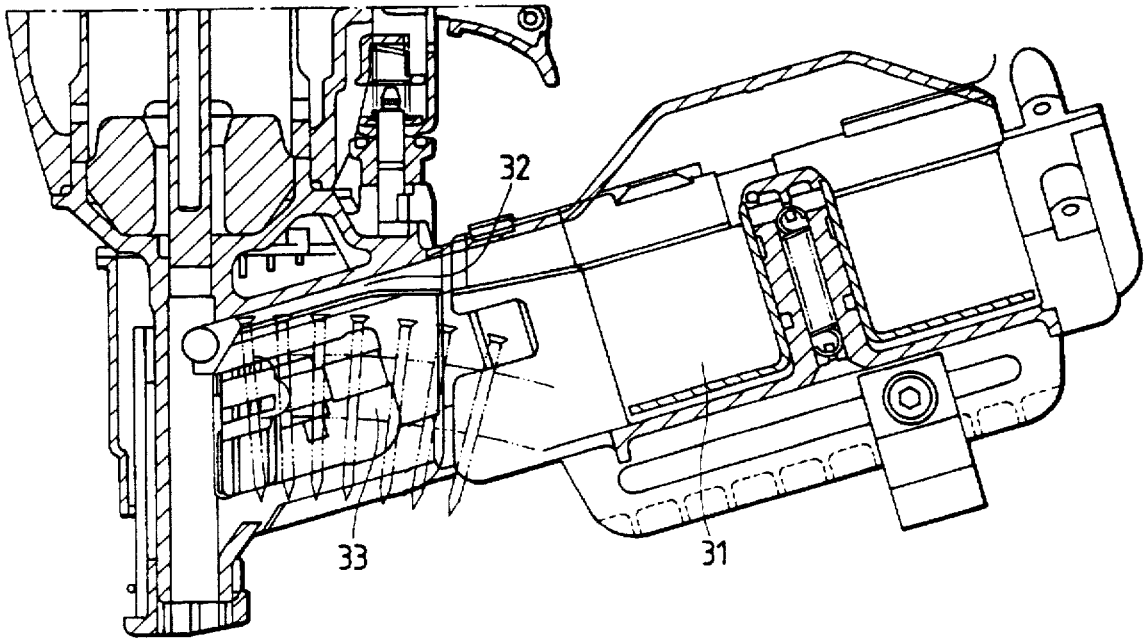
FIG. 8(a) PRIOR ART
FIG. 8(*a*) is a diagram outlining the arrangement of a conventional guide mechanism for wire-connected nails.
Figure 8B:
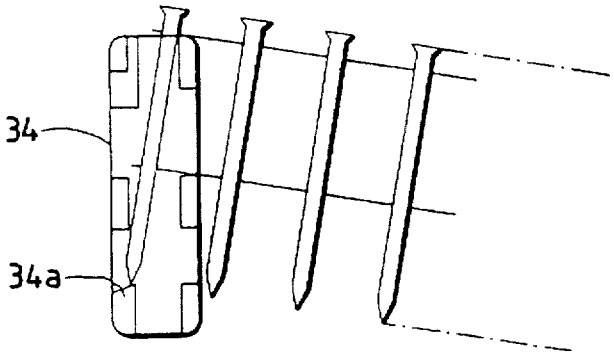
FIG. 8(b) PRIOR ART

In the above-described embodiment, one end portion of each of the ratchets **14*a* and 14*b* is pivotally mounted, so that the ratchets are each swung as a whole. On the other hand, there is available a nailing machine in which, as shown in FIGS. 7 and 8, its ratchet 26 slides in parallel. Springs 27** and 28 set between the bottom of the recess 17 formed in the door 7 and both sides of the ratchet 26, so as to move the ratchet 26 towards or away from the stationary wall 6. In the nailing machine, too, a guide piece 29 is formed along the nail guide passage 5. That is, the guide piece 29 is protruded towards the stationary wall 6 rather than towards the head guide 12, and engaged with the lower surface of the head of each of the series-connected nails 4, to support the latter.

Figure 6:
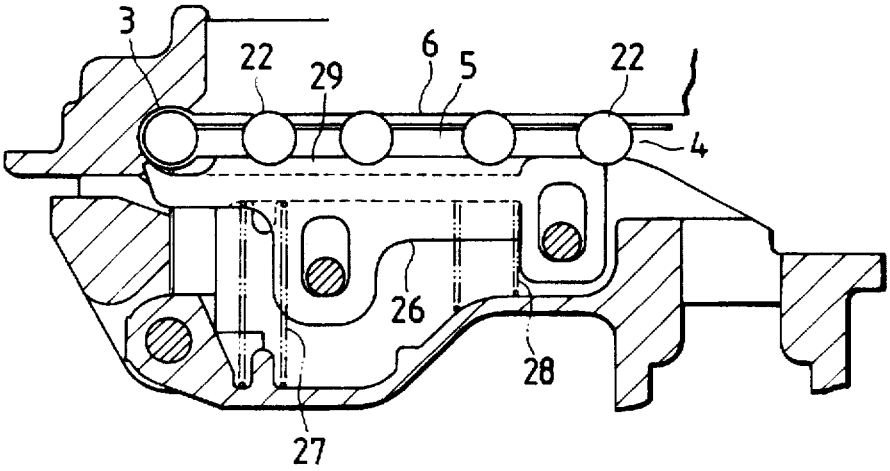
FIG. 6 is a sectional view of the nail guide passage including a cross-sectional view of a slide type ratchet.

That is, the ratchet 26 shown in FIGS. 6 and 7 is of slide type. The ratchet 26 slides according to the kind of series-connected nails (wire-connected nails, or sheet-connected nails) to adjust the width of the nail guide passage 5, and the series-connected nails 4 are supplied from the magazine while the lower surface of the head of each of the series-connected nails 4 is being supported by the guide piece. Hence, the slide type ratchet 26 has the same effects or merits as the above-described swing type ratchets. In this case, the lower ratchet may be of swing type similarly as in the case of FIG. 3.

I claim:

1. A guide mechanism for a nailing machine in which series-connected nails are fed from a magazine to a nose portion and the foremost nail of the series-connected nails is driven from a nail ejecting outlet of the nose portion by a driver, said guide mechanism comprising:

a stationary wall formed between the nose portion and the magazine;

a door pivotable with respect to said stationary wall;

a nail guide passage is defined by said stationary wall and by said door, for guiding the series-connected nails from the magazine to the nose portion;

a head guide attached to said door, said head guide being abutted against a side surface of the head of each of the series-connected nails to guide the head of each nail;

a shank guide which comprises an upper ratchet and a lower ratchet attached to said door, for guiding the shank of each nail, said shank guide including at least one of said ratchets being movable towards and away from said stationary wall to vary the width of said nail guide passage; and a guide piece attached to said upper ratchet of shank guide, said guide piece protruding towards said stationary wall rather than towards said head guide, to engage with a lower surface of the head of each of said series-connected nails to support each nail.

2. The guide mechanism according to claim 1, further comprising a shaft pivotally supporting said ratchets.

3. The guide mechanism according to claim 1, further comprising:

a groove formed on said ratchets; and a pin supported by said door, wherein said pin is inserted into said groove.

4. The guide mechanism according to claim 1, wherein said guide piece is adjacent to said head guide.

* * * * *